US005201274A

United States Patent [19]

Rinkewich

[11] Patent Number: 5,201,274

[45] Date of Patent: Apr. 13, 1993

[54] SHIP MOORING SYSTEM

[76] Inventor: Isaac Rinkewich, 48-22 Garden View Ter., Hightstown, N.J.

[21] Appl. No.: 780,508

[22] Filed: Oct. 22, 1991

[51] Int. Cl.[5] ..... B63B 21/00

[52] U.S. Cl. ..... 114/230

[58] Field of Search ..... 114/230, 293, 294; 441/3, 4, 5

[56] References Cited

U.S. PATENT DOCUMENTS

| | | | |
|---|---|---|---|
| 2,526,953 | 10/1950 | Kruse | 114/230 |
| 3,606,855 | 9/1971 | Saxonmeyer | 114/230 |
| 4,649,850 | 3/1987 | Akiba | 114/230 |
| 5,028,194 | 7/1991 | Robinson | 114/230 |

*Primary Examiner*—Jesus D. Sotelo
*Assistant Examiner*—Stephen P. Avila
*Attorney, Agent, or Firm*—Benjamin J. Barish

[57] ABSTRACT

A ship mooring system for securing a ship to a fixed object by means of a mooring cable, includes a mounting member pivotally mounted on the ship, a drum rotatably mounted at one end of the mounting member for receiving one end of the mooring cable, locking means for selectively unlocking or locking the drum against rotation, and a dashpot device engageable with the opposite end of the pivotal mounting member for absorbing tension forces applied to the mooring cable.

20 Claims, 1 Drawing Sheet

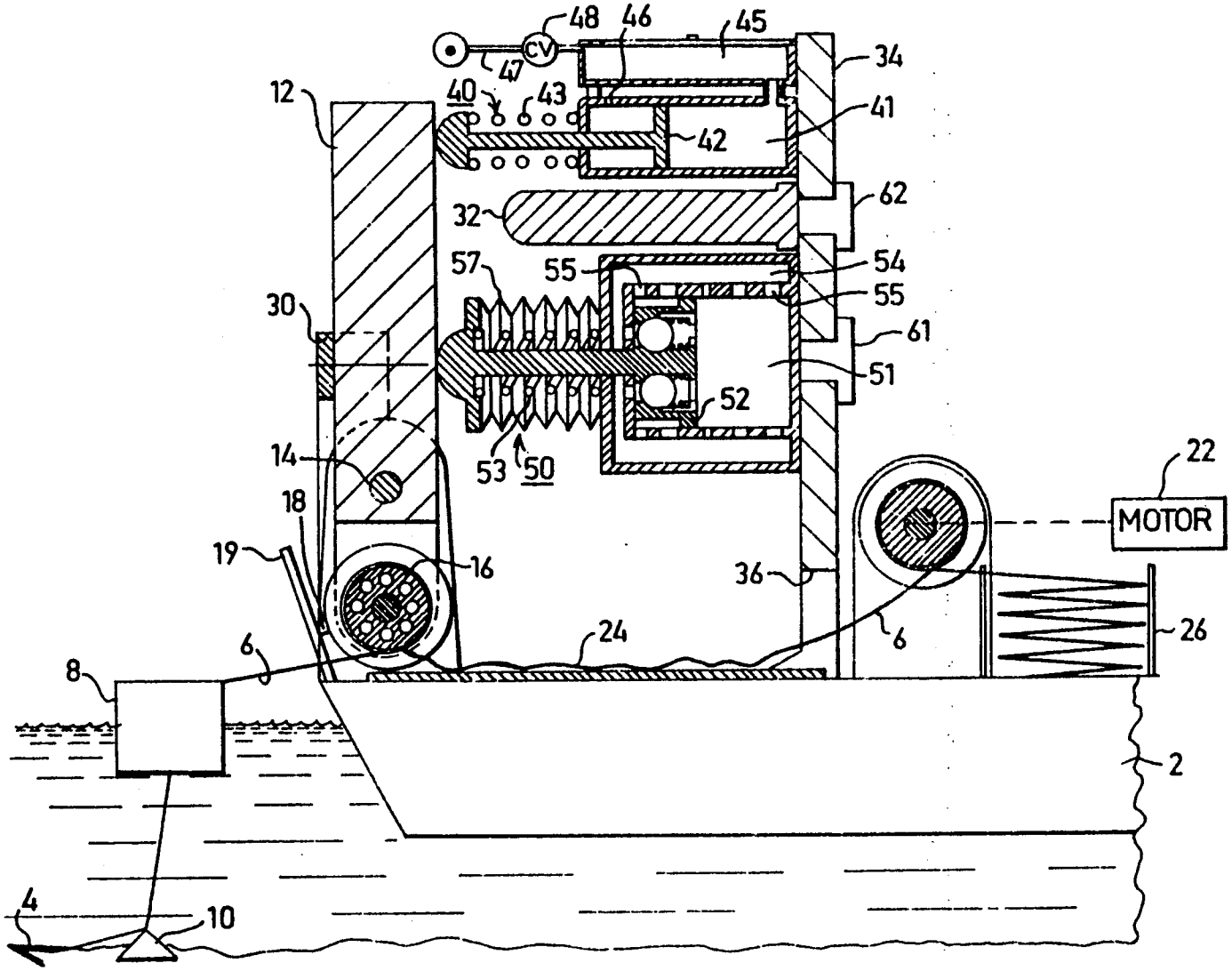
MOTOR
22
26
2
6
34
41
62
54
55
61
51
36
45
42
52
46
48
43
55
24
47
40
32
57
50
53
16
12
30
14
18
19
6
10
8
4

SHIP MOORING SYSTEM

FIELD AND BACKGROUND OF THE INVENTION

The present invention relates to ship mooring systems, and particularly to such systems which include a mooring cable (sometimes called a hawser cable) securing the ship to a fixed object, such as an anchor or a dock.

Moored ships commonly exhibit oscillatory behaviour, referred to as "fishtailing" or "kiting". Such behaviour results in very large tension forces being produced on the mooring cable as it restrains the ship at the ends of its swings. In many moorings, particularly shallow water moorings, this is a serious problem because the mooring system does not have sufficient capacity to absorb the tension surges. Failure of either the mooring system or the ship bow structure is not uncommon in these cases. If the mooring system fails, this could result in the loss of the ship and its contents, and also could cause considerable environmental damage. On the other hand, if the mooring system is too rigid to prevent the oscillatory movements of the ship, failure could occur at the bow of the ship. The latter possibility is particularly increasing because of recent trends to trade-off structural strength of ships in order to maximize the cargo-carrying capability of commercial ships, or the armament/weapons-carrying capability of combatant ships.

OBJECTS AND BRIEF SUMMARY OF THE INVENTION

An object of the present invention is to provide a ship mooring system which is capable of better absorbing the tension forces applied to the mooring cable, and thereby of decreasing the possibility of failure of either the mooring system or of the ship.

According to the present invention, there is provided a ship mooring system for securing a ship to a fixed object such as an anchor or a dock by means of a mooring cable having one end secured to the ship and the opposite end secured to the fixed object, comprising: a displaceable mounting member displaceably mounted on the ship; a drum rotatably mounted on the mounting member for receiving the one end of the mooring cable; and dashpot means urging the mounting member and drum to a normal position with respect to the ship but yieldable under tension forces applied to the mooring cable to permit displacement of the mounting member and drum in order to absorb the tension forces.

According to further features in the preferred embodiment of the invention described below, the drum includes locking means for selectively unlocking or locking it against the rotation. In addition, the displaceable mounting member is pivotally mounted to the ship, with the drum carried at one side of its pivotal mounting, and the dashpot means engageable with the mounting member on the opposite side of its pivotal mounting. Preferably, the ship carries a pair of limit stops on the opposite sides of the mounting member to limit its pivotal positions.

According to further features in the described preferred embodiment, the ship also carries a winch spaced from the rotatable drum and having the one end of the mooring cable wound thereon after having been wound on the rotatable drum. In addition, the ship includes a low-friction horizontal plate between the rotatable drum and winch for slidably receiving a slack portion of the mooring cable between the rotatable drum and winch.

A ship mooring system including the foregoing features enables the rotatable drum to be locked against rotation in order to absorb the tension forces applied to the mooring cable. When it is desired to pull-in the cable (e.g., to lift the anchor), the rotatable drum would be unlocked for rotation, and then the winch would be operated to pull-in the cable (e.g., to lift the anchor).

According to further features in the described preferred embodiment, the dashpot means comprises a first dashpot for absorbing relatively constant tension forces such as caused by water current; and a second dashpot for absorbing fluctuating tension forces such as caused by the wind. More particularly, each of the dashpots comprises a cylinder having a fluid therein; a plunger movable in the cylinder; a spring urging the plunger outwardly of the cylinder; and a fluid reservoir communicating with the interior of the cylinder via a restricted orifice through the cylinder wall for retarding the movements of the plunger by the mounting member.

Preferably, in the dashpot for absorbing the fluctuating tension forces, the fluid reservoir communicates with the interior of the cylinder via a plurality of restricted orifices through the cylinder wall spaced along its length and sequentially coverable by the plunger during its movement in the cylinder. Such an arrangement provides a more effective shock absorbing action in that the retarding force imposed by the dashpot device increases with the displacement of the plunger.

Further features and advantages of the invention will be apparent from the description below.

BRIEF DESCRIPTION OF THE DRAWING

The invention is herein described, by way of example only, with reference to the single drawing figure diagrammatically illustrating one preferred embodiment of a ship mooring system in accordance with the present invention.

DESCRIPTION OF A PREFERRED EMBODIMENT

The ship mooring system illustrated in the drawing is shown as applied to the bow of a ship 2 for securing the ship to a fixed object, such as an anchor 4 by means of a mooring cable 6. The mooring cable 6 connected between the bow of the ship and the anchor further includes a buoy 8 and a sinker 10.

The mooring system comprises a mounting member 12 pivotally mounted by axle 14 to the bow of the ship 2. The lower end of the pivotal mounting member 12 carries a rotatable drum 16, serving as a capstan for receiving one end of the mooring cable 6. Drum 16 may be selectively locked against rotation, as schematically shown by locking pin 18. For example, the locking pin may be carried at the end of a pivotal lever 19 movable to one position to cause the locking pin 18 to lock drum 16 against rotation, or to another position releasing the locking pin from the drum to permit drum rotation.

The ship 2 further includes a winch or windless 20 adapted to be driven by a motor drive shown schematically at 22. Winch 20 is spaced forwardly of drum 16 and receives the end of the mooring cable 6 after the cable has been wound around the drum 16. The space between winch 20 and drum 16 is occupied by a low-friction horizontal plate 24, e.g., of "Teflon" TM. Plate 24 normally receives a slack portion of the mooring cable between the drum 16 and winch 20 when the drum 16 is locked against rotation for absorbing the tension forces applied to the mooring cable, as will be described more particularly below. Winch 20 is used for drawing-in the cable (e.g., for lifting the anchor 4), at which time drum 16 is permitted to rotate so that the winch 20 first pulls in the slack cable on the horizontal plate 24 and then rotates the drum 16 to lift the anchor. The winch 20 may include a receptacle 26 for receiving the reserve mooring cable.

The upper end of the pivotal mounting member 12 is engageable by a pair of limit stops 30, 32 on the opposite sides of the mounting member to limit its pivotal positions. Thus, stop 30 is carried at the end of the ship bow, whereas stop 32 is carried by a fixed mounting member 34 located between the pivotal mounting member 12 and the winch 20. The fixed mounting member 34 is formed with an opening 36 for accommodating the mooring cable 6 received on the winch 20 from the rotatable drum 16.

The upper end of the pivotal mounting member 12 is also engageable by a pair of dashpot devices, shown at 40 and 50, respectively. Dashpot device 40 engages the outer end of the pivotal mounting member 12 and is effective to absorb relatively constant tension forces, such as caused by the water current. Dashpot device 50 is engageable by the pivotal mounting member 12 closer to its pivotal mounting 14 and is effective to absorb fluctuating tension forces, such as caused by the wind. Both dashpot devices 40 and 50 are mounted to the fixed mounting member 34 carrying the stop 32.

Dashpot device 40, for absorbing relatively constant tension forces, includes a cylinder 41, a plunger 42 movable in the cylinder, a spring 43 urging the plunger outwardly of the cylinder, and a fluid reservoir 44 communicating with the interior of cylinder 41 via a restrictor orifice 45 through the cylinder wall. Cylinder 41 further includes a vent 46 on the opposite side of the plunger 42. The fluid supplied to reservoir 44 may be air, oil, or the like, and is supplied via a fluid line 47 which includes a check valve regulator 48.

Dashpot device 50, which is used for absorbing fluctuating tension forces applied to the mooring cable 6, also includes a cylinder 51, a plunger 52 movable therein, a spring 53 urging the plunger outwardly of the cylinder, and a fluid reservoir 54. In this case, however, the fluid reservoir 54 communciates with the interior of cylinder 51 via a plurality of restrictor orifices 55 formed through the cylinder wall and spaced along its length so as to be sequentially coverable by the plunger 52 during its movement in the cylinder. Such an arrangement produces a more effective shock-absorbing action, particularly with respect to large fluctuating tension forces applied to the mooring cable 6, since the retarding force imposed by plunger 52 increases with the displacement of the plunger within the cylinder 51.

In the dashpot device 50, the spring 53 is covered by a bellows 57.

The fixed mounting member 34 further carries a force transducer 60 exposed to the force within cylinder 51 of the dashpot device 50, and thereby measures the force applied to that dashpot device by the pivotal mounting member 12. A second force transducer 62 is carried by the fixed supporting member 34 in alignment with the fixed stop 32 so as to measure the force applied by the pivotal mounting member 12 to that stop. The forces measured may be recorded, displayed, and/or used for control purposes.

The manner of using the ship mooring system illustrated in the drawing will be apparent from the above description. Thus, when the ship is normally moored, e.g., to the anchor 4 (or to a fixed dock), the mooring cable 6 is wound around drum 16, and the drum is locked against rotation by locking pin 18. A slack portion of the mooring cable then extends over the horizontal Teflon TM plate 24 and is wound around the winch 20, with a reserve portion of the cable being received within receptacle 26.

As tension forces are applied to the mooring cable, for example by the current flow or by the wind, these tension forces are transmitted to drum 16, and since the drum is locked against rotation, to the pivotal mounting member 12, tending to pivot the latter member clockwise about its pivot axle 14. These pivotal movements are resisted by the two dashpots 40, 50. Dashpot 40 tends to asborb the relatively constant tension forces, such as caused by water currents, whereas dashpot 50 tends to absorb the fluctuating tension forces, such as caused by the wind.

If substantial tension forces are to be absorbed, such as those produced by the wind and absorbed by dashpot 50, this dashpot device 50, as well as dashpot device 40, could be provided with means (not shown) for dissipating the heat produced in the fluid (e.g., oil) used in the dashpot. As mentioned earlier, dashpot 50 produces an effective absorption action particularly with respect to large tension forces since the retarding force imposed by its plunger 52 increases with the displacement of the plunger within cylinder 51 because of the plurality of restrictor orifices 55 formed in the wall of the cylinder which are successively covered by the displacement of the plunger.

The displacement of drum 16 at the lower end of the pivotal mounting member 12 is accommodated by the slack cable on the Teflon TM plate 24 between drum 16 and winch 20.

When it is desired to pull-in the mooring cable 6, e.g., for raising the anchor 4, winch 20 is operated to take-up the slack cable on the Teflon TM plate 24; and then the locking pin 18 is removed so as to release the drum for rotation. The winch 20 is then further operated to rotate the drum 16 and thereby to pull-in the mooring cable 6.

Many variations will be apparent. For example, the mounting member 12 could be slidably displaceable, rather than pivotal. In addition, drum 16 could be provided with a motor drive so as also to serve the function of the winch 20 when pulling-in the cable.

Many other variations, modifications and applications of the invention will be apparent.

What is claimed is:

1. A ship mooring system for securing a ship to a fixed object such as an anchor or a dock by means of a mooring cable having one end secured to the ship and the opposite end secured to the fixed object, comprising:

a displaceable mounting member displaceably mounted on said ship;

a drum rotatably mounted on said mounting member for receiving said one end of the mooring cable;

and dashpot means urging said mounting member and drum to a normal position with respect to said ship but yieldable under tension forces applied to said mooring cable to permit displacement of said mounting member and drum with respect to said ship in order to absorb said tension forces.

2. The system according to claim 1, wherein said drum includes locking means for selectively unlocking or locking the drum against rotation.

3. The system according to claim 1, wherein said ship carries a winch spaced from said rotatable drum and having said one end of the mooring cable wound thereon after having been wound on said rotatable drum.

4. The system according to claim 3, further including a low-friction horizontal plate between said rotatable drum and winch for slidably receiving a slack portion of the mooring cable between the rotatable drum and winch.

5. The system according to claim 4, further including a receptacle for receiving reserve mooring cable from said winch.

6. The system according to claim 1, wherein said dashpot means comprises:

a first dashpot for absorbing relatively constant tension forces such as caused by water current;

and a second dashpot for absorbing fluctuating tension forces such as caused by the wind.

7. The system according to claim 4, wherein each of said dashpot devices comprises:

a cylinder having a fluid therein;

a plunger movable in said cylinder;

a spring urging said plunger outwardly of said cylinder;

and a fluid reservoir communicating with the interior of said cylinder via a restricted orifice through the cylinder wall for retarding the movements of said plunger by said mounting member.

8. The system according to claim 7, wherein in at least one of said dashpots, said fluid reservoir communicates with the interior of said cylinder via a plurality of restricted orifices through the cylinder wall spaced along the length thereof and sequentially coverable by said plunger during its movement in the cylinder.

9. The system according to claim 1, wherein said dashpot means includes a force transducer for measuring the force applied thereto by said displaceable mounting member.

10. A ship mooring system for securing a ship to a fixed object by means of a mooring cable having one end secured to the ship and the opposite end secured to the fixed object, comprising:

a pivotal mounting member pivotally mounted on said ship;

a drum rotatably mounted at one end of said mounting member for receiving said one end of the mooring cable;

locking means for selectively unlocking or locking the drum against rotation;

and dashpot means engageable with the opposite end of said pivotal mounting member for absorbing tension forces applied to said mooring cable.

11. The system according to claim 10, wherein said ship carries a pair of limit stops on the opposite sides of said mounting member to limit the pivotal positions thereof.

12. The system according to claim 11, wherein said ship carries a winch spaced from said rotatable drum and having said one end of the mooring cable wound thereon after having been wound on said rotatable drum.

13. The system according to claim 12, further including a low-friction horizontal plate between said rotatable drum and winch for slidably receiving a slack portion of the mooring cable between the rotatable drum and winch.

14. The system according to claim 13, wherein said dashpot means comprises:

a first dashpot for absorbing relatively constant tension forces such as caused by water current;

and a second dashpot for absorbing fluctuating tension forces such as caused by the wind.

15. The system according to claim 14, wherein each of said dashpot devices comprises:

a cylinder having a fluid therein;

a plunger movable in said cylinder;

a spring urging said plunger outwardly of said cylinder;

and a fluid reservoir communicating with the interior of said cylinder via a restricted orifice through the cylinder wall for retarding the movements of said plunger by said mounting member.

16. The system according to claim 15, wherein in at least one of said dashpots, said fluid reservoir communicates with the interior of said cylinder via a plurality of restricted orifices through the cylinder wall spaced along the length thereof and sequentially coverable by said plunger during its movement in the cylinder.

17. The system according to claim 16, wherein said dashpot means includes a force transducer for measuring the force applied thereto by said displaceable mounting member.

18. A ship mooring system for securing a ship to a fixed object such as an anchor or a dock by means of a mooring cable having one end secured to the ship and the opposite end secured to the fixed object, comprising:

a pivotal mounting member pivotally mounted on said ship;

a drum rotatably mounted on said mounting member for receiving said one end of the mooring cable;

and dashpot means urging said mounting member and drum to a normal position with respect to said ship but yieldable under tension forces applied to said mooring cable to permit displacement of said mounting member and drum in order to absorb said tension forces.

19. The system according to claim 18, wherein said mounting member carries said drum at one end of its pivotal mounting and engages said dashpot means on the opposite end of said pivotal mounting.

20. The system according to claim 19, wherein said ship carries a pair of limit stops on the opposite sides of said mounting member to limit the pivotal positions thereof.

* * * * *